United States Patent [19]

Lanier

[11] 4,078,759

[45] Mar. 14, 1978

[54] PORTABLE DECKING SYSTEM

[75] Inventor: John Elbert Lanier, Alexandria, Va.

[73] Assignee: Alproco, Inc., Melbourne, Fla.

[21] Appl. No.: 712,919

[22] Filed: Aug. 9, 1976

[51] Int. Cl.[2] ..... E04G 11/56; E04G 25/06

[52] U.S. Cl. ..... 249/18; 214/1 D; 248/354 P; 249/189; 425/62

[58] Field of Search ..... 425/62; 249/13, 18, 249/188, 189; 214/1 D, 1 H, 1 SW; 248/354 P

[56] References Cited

U.S. PATENT DOCUMENTS

| | | | |
|---|---|---|---|
| 2,825,477 | 3/1958 | Ross | 214/1 D |
| 2,828,870 | 4/1958 | Corley | 214/1 SW |
| 3,940,105 | 2/1976 | Metrailer | 249/18 |
| 3,977,536 | 8/1976 | Moore et al. | 425/62 |

FOREIGN PATENT DOCUMENTS

| | | | |
|---|---|---|---|
| 2,266,781 | 10/1975 | France | 248/354 P |

*Primary Examiner*—Francis S. Husar
*Assistant Examiner*—John McQuade

[57] ABSTRACT

A portable decking system comprising a transporter, decking panels and support or shoring means. The transporter is provided with wheels so as to be movable and is used to transport and position the decking panels and/or the shoring means. Lifting means is provided on the transporter to selectively raise or lower a decking panel to a desired position. Once a decking panel is properly positioned by the transporter, the shoring means are utilized to support the decking panels and the transporter is removed. Each decking panel has mounted on its upper surface a plate on which concrete is poured. Each shoring means is provided with adjusting means for selectively adjusting the length thereof to facilitate the positioning and removal of the shoring means.

10 Claims, 10 Drawing Figures

PORTABLE DECKING SYSTEM

BACKGROUND OF THE INVENTION

This invention relates to a decking system for concrete construction and, more particularly, to a portable decking system which facilitates the construction of modular building units having a monolithic slab roof.

For economic purposes, in both operation and initial construction, many building units, such as office buildings, motels or hotels, are constructed today on a modular plan wherein each of the various units, whether a single room or a suite, are all substantially identical. Further, they are preferably constructed of reinforced concrete, a material which is durable, provides useful insulation as to sound and heat and is inexpensive, both for the material itself and, potentially at least, in the method of construction. To further decrease the cost of construction with concrete, it is preferred to form the vertical walls defining the individual residential modules and then to pour a monolithic massive concrete ceiling extending over a series of such modules, or bays, defined by the vertical walls. The vertical walls serve to support the massive concrete ceiling. The ceiling can be the top roof of the structure or can be an intermediate horizontal level defining the ceiling of a lower level and the floor of a higher level.

Present conventional practice is to form the vertical walls defining the modules or bays and then to construct scaffolding and to place on that scaffolding generally flat mold surfaces which form the ceiling of the bay, and, if a multi-story structure is being formed, the floor of the next higher level. Such scaffoldings and mold surfaces are normally made of wood. Owing to the relatively high labor cost today and the expense and scarcity of wood, such conventional scaffolding and mold surfaces represent a major expense in concrete construction today, particularly due to the short life of wood construction, in both labor and material costs.

There have been attempts to provide support structures for the pouring of the concrete ceiling/floor which are of a more or less portable nature and which can be utilized to form such a massive roof. For example, Stout, in U.S. Pat. No. 3,728,838, shows a structure and method for pouring in place a unitary concrete roof. The temporary casting support is level and flat, but requires dismantling after each use before the support structure can be moved to another site. Similarly, Varlonga, U.S. Pat. No. 3,674,232, describes the formation of suspended concrete floors wherein the main support beams for the temporary support structure are also utilized as the permanent support structure for the concrete flooring. Such means also requires dismantling after each use. Also, see Sullivan, U.S. Pat. No. 3,630,479, and Comment, U.S. Pat. No. 3,502,296, for further examples of prefabricated concrete pouring forms. Further, see Jennings, U.S. Pat. No. 3,409,266.

The use of portable forms which are constructed once and then can be moved from place to place, usually on a supporting wheel carriage, have also been suggested for use in construction. These have generally not found success in the industry for various reasons, for example, their bulkiness, weight, great expense, or other design failures to provide for all of the requirements to be met in the construction of particular buildings. For example, U.S. Pat. Nos. 3,037,259 and 2,966,718, both to Dave, describe various types of decking forms for the pouring of a monolithic concrete ceiling which is supported by a plurality of columns regularly spaced beneath the flooring. The forms used by Dave preferably are plywood and are supported upon a wheeled vehicle. Dave further requires the use of intermediate removable elements between adjoining plywood forms in order to form a continuous support structure. Also, see Kohlhaas, U.S. Pat. No. 2,377,944. Another concrete pouring form for forming a modular concrete ceiling, level or arched, which can be carried and moved about on a carriage, but which must be detached from the carriage when in use, is shown by Metrailer, U.S. Pat. No. 3,744,945.

A completely portable unit on a wheeled carriage has been described as being useful for forming a continuous intermediate floor or uppermost ceiling in a structure having a modular design with intermediate vertical walls for supporting the ceiling, as shown by Haws, U.S. Pat. No. 3,659,977. The Haws device is also useful for forming vertical walls. There is no provision for the utilization of two adjoining units by Haws for forming a continuous ceiling over a series of modular units, nor is there provision for forming a ceiling which extends beyond the vertical supporting walls. The mold surfaces of Haws further are extremely heavy, thick structures, which are rigid and intended to support the entire weight of the concrete being poured.

A variety of units for forming massive hyperbolic or parabolic ceiling constructions are shown, for example, in the U.S. Pat. No. 3,234,620 to Short, and U.S. Pat. No. 3,320,646 to Wilkins.

The construction industry, however, remains in need of a successful means for quickly and efficiently pouring a massive monolithic concrete roof, or suspended floor, for a modular type of building, where the support structure for the mold is relatively lightweight, can be quickly and easily transported into position and then readily moved, once the concrete structure has set, to the next position, and can be reused almost indefinitely. Such a structure, in addition to being quickly transportable, must provide the necessary support to form a flat and level structure and must provide the necessary continuity to form the monolithic roof, when a plurality of different units are utilized to form a massive unitary roof for a large number of modules simultaneously.

In accordance with the present invention, there is provided a portable, lightweight decking system providing a continuous surface for the support of a monolithic slab of poured concrete during setting thereof, designed and adapted for use in conjunction with a plurality of other like units for the formation of a monolithic roof structure for a plurality of modular building units separated by vertical support walls or the like.

SUMMARY OF THE INVENTION

The present invention provides a reusable, strong, lightweight and inexpensive decking system for monolithic pours of concrete in the construction of single or multi-level buildings of all types — a decking system that greatly reduces the cost of present day decking techniques, eliminates the need for costly lumber which has a very short life usage, and is portable and will last for many years.

The portable decking system of the present invention comprises three major components — the transporter, decking panels, and support or shoring means, all of which preferably are made of aluminum or another suitable material.

The transporter is a portable, wheeled vehicle used to transport and position the decking panels. The four wheels of the transporter allow it to rotate and move in any direction. A hydraulic jack or other lifting means mounted on the transporter, is used to either raise or lower a decking panel mounted thereon. The decking panel, when raised, can also be rotated in any direction. The transporter is provided with means for securing a panel to it when the transporter is in motion, and has adjustable rollers that enable panels to easily be loaded or unloaded from the transporter. The transporter is adjustable in size, and may also be used to move shoring to locations, either with the panels or separately.

The decking panels may vary in size, with an exemplary size being 6 feet by 16 feet and covering an area of 96 square feet. These panels preferably are constructed of aluminum extrusions and plate aluminum. The extrusions are hollow and permit smaller extrusions or extenders to slide into the ends thereof. Extenders are used to support decking in areas between standard panels and walls. The decking panels have plates or the like secured to the upper surfaces thereof on which the concrete is poured. The plates may be of a construction such as that disclosed in my copending application Ser. No. 471,315, filed May 20, 1974, now U.S. Pat. No. 4,003,541.

The shoring means are used to support the decking panels once they are positioned in place by the transporter. Each shoring means is adjustable in length providing several feet of extension in small intervals, such as one-quarter inch. Another feature of the shoring is an adjusting device which, when moved, allows the shoring to be reduced in length just enough to permit removal from the weight of the poured concrete. The adjusting device can also be positioned to set the shoring height within small adjustments such as one-quarter inch. The top section of each shoring means is removable so that other sections of different designs may be used if required.

The following is a general example of how the portable decking system of the present invention may be used in the construction of houses, office buildings, apartment complexes, motels, and other structures requiring areas to be formed for decking.

An applications engineer reviews building plans to determine how much decking equipment will be required on the job site. A carrier vehicle transports the equipment. A decking panel is rolled onto the transporter and secured in place. Shoring means may be stored and moved on the transporter. Usually two men will roll the transporter with panel and shoring into position. The transporter jack or lifting means raises the panel just above its required height. All shoring means are adjusted to the exact required height and placed into position under the panel. The jack lowers the panel onto the shoring. The transporter rolls away from under the panel and is then used to pick up another panel and shoring means. This procedure is repeated until the required area to be decked is complete. If there is space left between panels and walls, extenders are used to support the decking needed to fill these spaces. As the panels are placed into position, they are aligned and secured to each other. This strengthens the system and assures surface flatness. After the area has been completely formed for decking, workers, such as electricians, plumbers, etc. perform certain operations before the concrete is poured. After the concrete is poured and has had time to set, the transporter is rolled into position under a panel. The jack is raised until it is firm against the panel. The shoring is removed and placed on the transporter. The jack then lowers the panel onto the transporter. The transporter either takes equipment back to the carrier for relocation to another job site, or it may continue moving equipment on site to form decking for other areas, wings, or levels. When going up to form another level, a crane or other lifting device, with an adjustable sling secured to the transporter, raises the transporter, panel, and shoring to the next level.

The following is another method of use of the portable decking system of the present invention on larger buildings or high rises with larger repetitive spaces to be formed for decking. Usually, two transporters would be used for high rises.

Assume a high rise with 10 stories or levels, and 10 bays per level. Each bay is 12 feet wide and 32 feet long. The first level, or any level or areas not repetitive in size to the others, may be formed in accordance with the procedures given for general forming using the portable decking system. The remaining levels may be formed as follows.

Temporarily, shoring is placed at some random area on the ground. The transporter positions four each six by sixteen foot panels on the shoring. Sling support brackets are placed at several locations between the panels, and the panels are secured to each other in any suitable manner. The transporter and shoring are raised to a level. An adjustable sling is attached to the panel brackets and a crane lifts the unitary panel onto the transporter. The transporter is used to position the panel into place. The shoring is positioned and the panel is lowered. The transporter is removed and return to repeat the cycle for another bay.

After the concrete has been poured and has had time to set, the transporter is positioned under the panel. The shoring is removed from under the panel, and the panel is lowered onto the transporter. The sling is attached to the panel and the crane rolls the panel off of the transporter and raises it to the next bay above. The panel or "flying form" in this example, covers three hundred and eighty four square feet. Usually ten of these panels would be placed to form an entire level, and a continuous pour of concrete made. After the concrete is set, these ten panels will be moved to form the next level, and its 10 bays.

This technique of using the panels for large high rise structures, that require large repetitive areas to be formed for decking, greatly reduces labor, time and cost.

DESCRIPTION OF THE PREFERRED EMBODIMENTS

Figure 1:
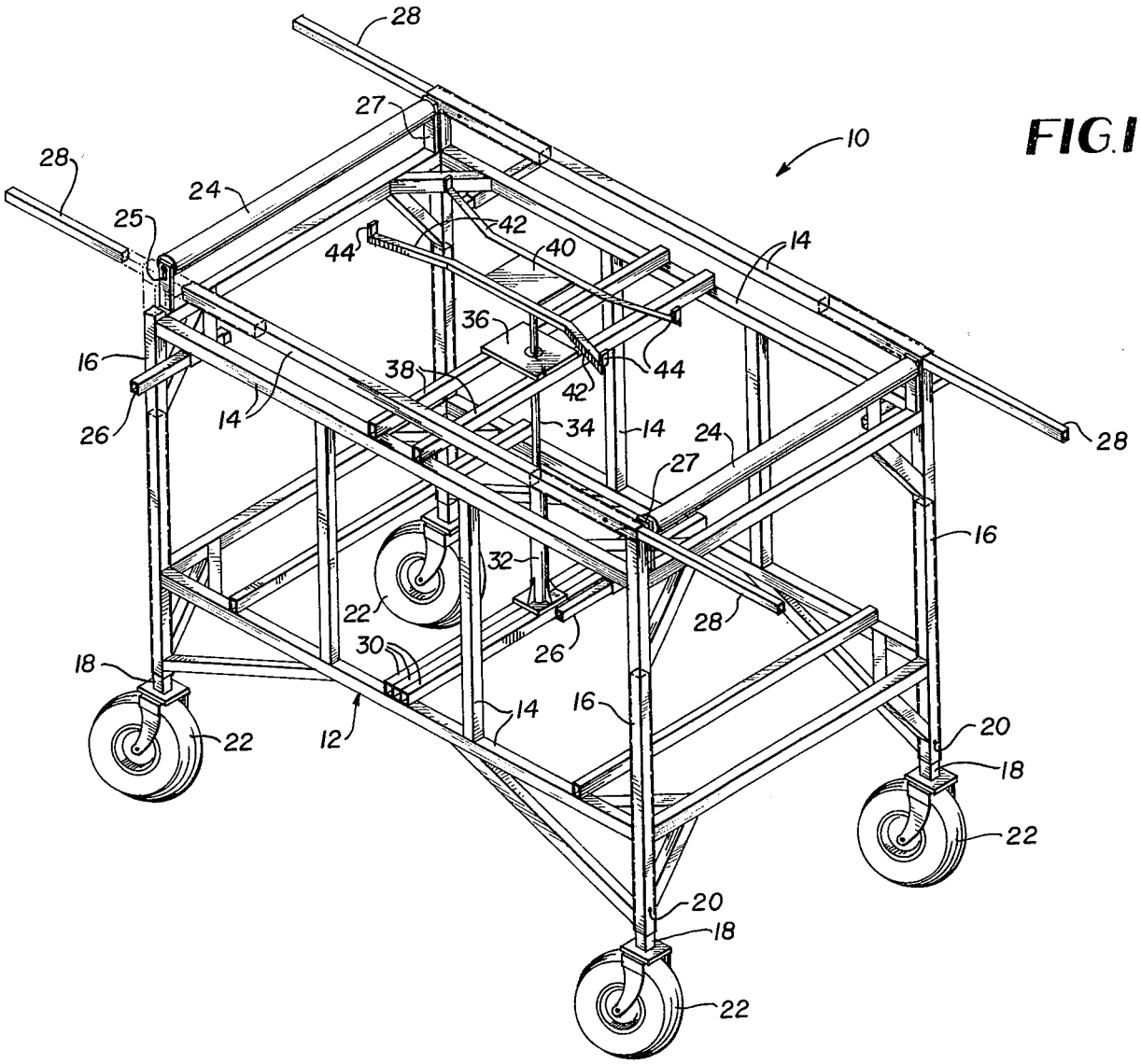
FIG. 1 is a perspective view of the transporter of the subject portable decking system.

FIGS. 1 through 4 illustrate the transporter 10 of the portable decking system of the present invention. As hereinbefore explained, the transporter 10 is used to move and position decking panels. It may also be used to move shoring means for the decking panels.

The transporter 10 generally comprises a support structure or frame 12 formed of tubular sections 14 connected in any suitable manner. Preferably, the tubular sections are formed of a strong, lightweight material, such as aluminum, and are of square or rectangular cross section. The frame 12 comprises downwardly extending leg portions 16 at each corner thereof in which leg members 18 are telescopically received. The leg members 18 are vertically adjustable within the leg portions 16 to vary the height of the transporter 10 and may be locked in a desired position by placing a suitable locking means, such as a pin 20 in mating apertures in a leg portion 16 and leg member 18.

Each of the leg members 18 is provided with a wheel 22 at the bottom end thereof which is rotatable substantially about the axis of the leg member 18 to provide for universal rolling movement of the transporter 10. The wheels 22 may be connected to the leg members 18 in any suitable manner and may be of any desired construction. Preferably, each wheel 22 comprises a pneumatic tire to facilitate movement over rough terrain that is normally encountered at construction sites.

At each end of the upper portion of the transporter 10 a roller 24 is rotatably mounted thereon in any suitable manner. The rollers 24 serve to facilitate the loading, the positioning and unloading of decking panels on the upper portion of the transporter in a manner to be more specifically described hereinafter. The rollers 24 may be formed of any suitable manner. Preferably, the rollers 24 are vertically adjustable in any suitable manner in slots 25 in the support brackets 27 therefor.

Figure 3:
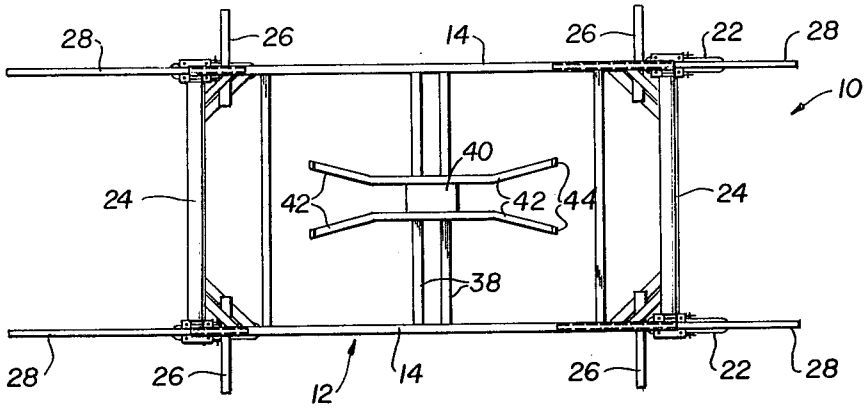
FIG. 3 is a plan view of the transporter shown in FIG. 1.
Figure 4:
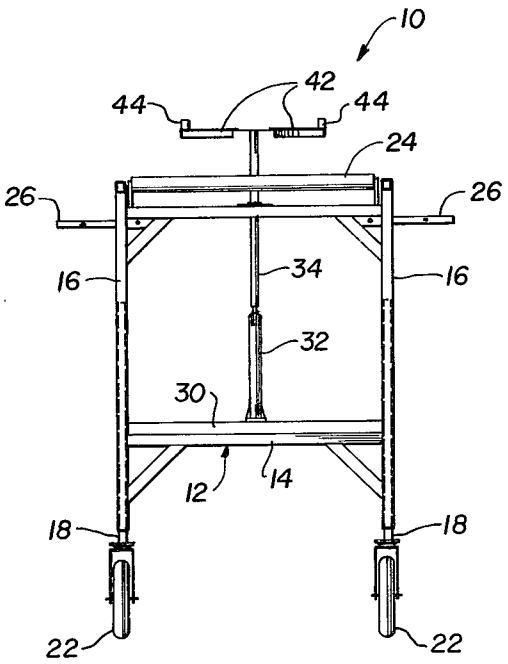
FIG. 4 is an end elevational view of the transporter shown in FIG. 1.

A plurality of sling support members 26 are slidably mounted on the frame 12 for substantially horizontal movement in any suitable manner. Preferably, each sling support member 26 is movable between an inoperative position wherein it is located within the confines of the frame 12, and an operative position wherein it extends laterally outwardly from the frame 12 as shown in FIGS. 1, 3 and 4. In the operative position, the sling support members 26 may be engaged by any suitable form of sling so that the transporter 10 may be lifted by a crane or the like to levels above ground level. The sling support members 26 may be releasably locked in the operative or inoperative positions by any suitable locking means, such as a pin positioned through mating apertures in the sling support members and the portions of the frame 12 on which they are slidably mounted.

Figure 2:
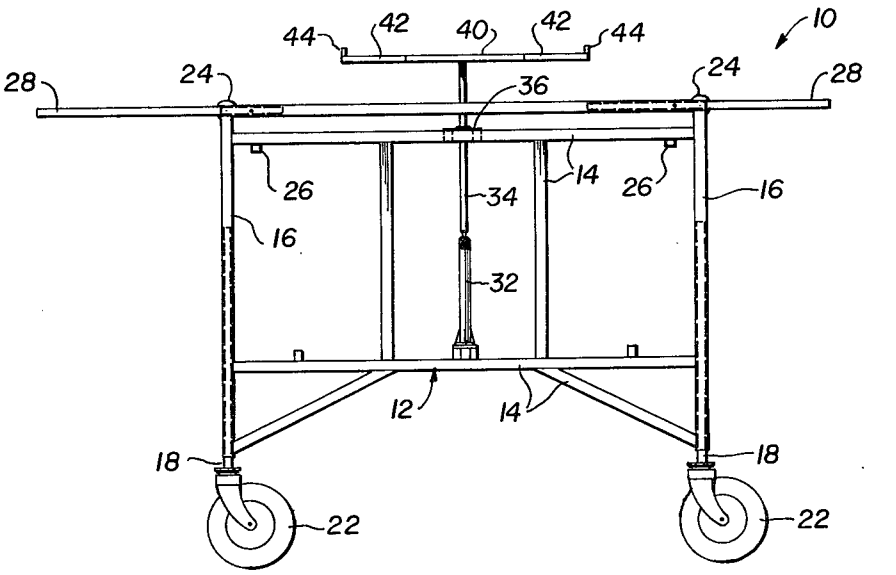
FIG. 2 is a side elevational view of the transporter shown in FIG. 1.

As shown in FIGS. 1 through 3, the length of the transporter 10 may be varied by the provision of extension members 28 that are telescopically mounted within the end portions of upper members 14 of the frame 12. The extensions 28 may be secured in a desired position by any suitable locking means, such as a locking pin positioned between mating apertures in the extension members 28 and the frame members 14.

Mounted on cross members 30 at the lower center portion of the frame 12 is a lifting means of any suitable construction, such as a hydraulic jack 32 or the like. Preferably, the jack 32 comprises an upstanding movable rod portion 34 that extends through an aperture in a support plate 36 that is secured to cross members 38 at the upper mid portion of the frame 12. A generally horizontally extending platform 40 is secured to the upper end of the rod portion 34 of the jack 32. The platform 40 may be of any suitable construction and is adapted to support thereon a portion of a decking panel in a manner to be described more fully hereinafter. Preferably, the platform 40 comprises four outwardly extending arms 42, each having an upwardly extending locking member or lug 44 at the outer end thereof. The locking members 44 serve to releasably retain a decking panel on the platform 40 when it is being moved upwardly or downwardly by the jack 32, in a manner to be described more specifically hereinafter. Preferably, the rod member 34 is rotatable such that the platform 40 is rotatable to facilitate the proper positioning of a decking panel mounted thereon.

Figure 5:
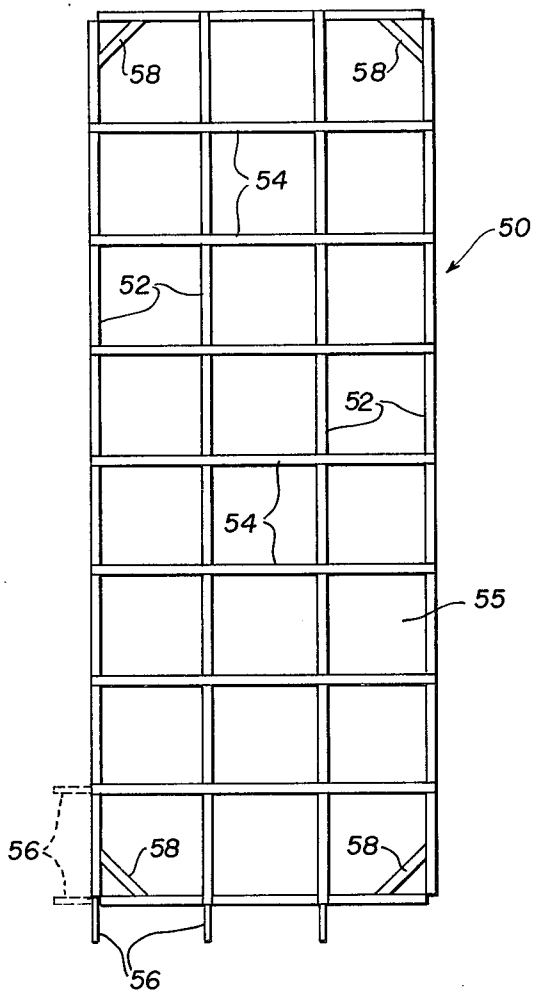
FIG. 5 is a plan view of a decking panel of the subject portable decking system.
Figure 6:
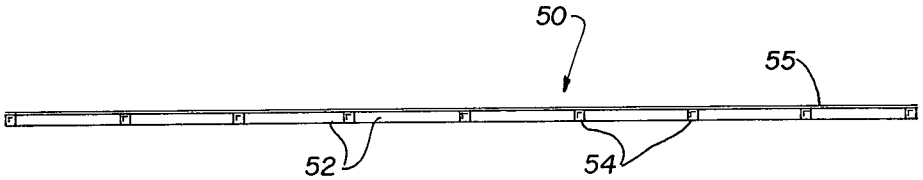
FIG. 6 is a side elevational view of the decking panel shown in FIG. 5.
Figure 7:
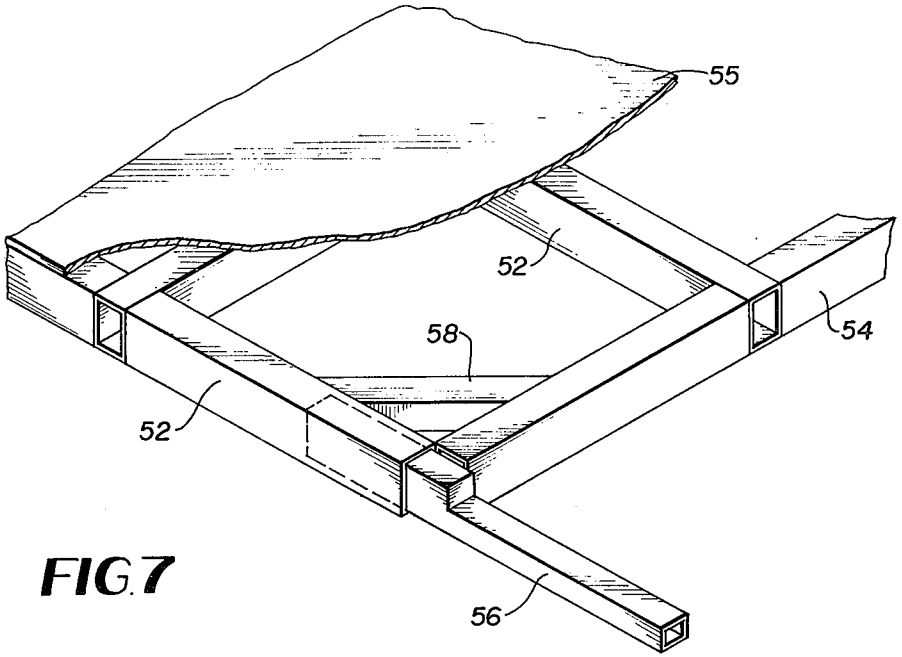
FIG. 7 is an enlarged perspective view of a portion of the decking panel shown in FIG. 5.

FIGS. 5 through 7 illustrate a decking panel 50 of the portable decking system of the present invention. The decking panel 50 preferably is formed of a plurality of longitudinally and transversely extending members 52 and 54, respectively, that are secured together in any suitable manner. As an illustrative example, the members 52, 54 may be formed of tubular members of square or rectangular cross section made of a strong, lightweight material such as aluminum. A plate 55, preferably formed of a strong, lightweight material such as aluminum, is secured to the upper side of the members 52 and 54 in any suitable manner, as shown in FIGS. 6 and 7. The plate 55 is adapted to receive concrete thereon when the decking panel 50 is properly positioned by the transporter 10. The decking panel 50 of the present invention, therefore, is a grid like support member which may be of any suitable size or configuration on which concrete is poured.

As shown in FIGS. 5 and 7, the ends of the longitudinal members 52 and transverse members 52 at each corner of the decking panel 50 are open and recessed so as to telescopically receive therein one or more extension members 56 for the purpose of varying the length or width of the panel. The ends of the intermediate members 52 and 54 are also open so as to be adapted to slidably receive the extension members 56. The extension members 56 may be releasably positioned within the members 52 and 54 of the decking panel 50 in any suitable manner, such as by a locking pin (not shown) extending through mating apertures (not shown) in the extension members 56 and the members 52 and 54, in a manner similar to the extension members 28 of the transporter 10 shown in FIGS. 1 through 4.

If desired, an extension member 56 may be recessed in the manner shown in FIG. 7 or in any other desired manner for the purpose of accommodating plate connecting means (not shown), a plate, form or filler section of greater thickness or the like.

The corner members 52 and 54 of the decking panel 50 are secured together by corner bracing members 58 or any other suitable means.

Figure 10:
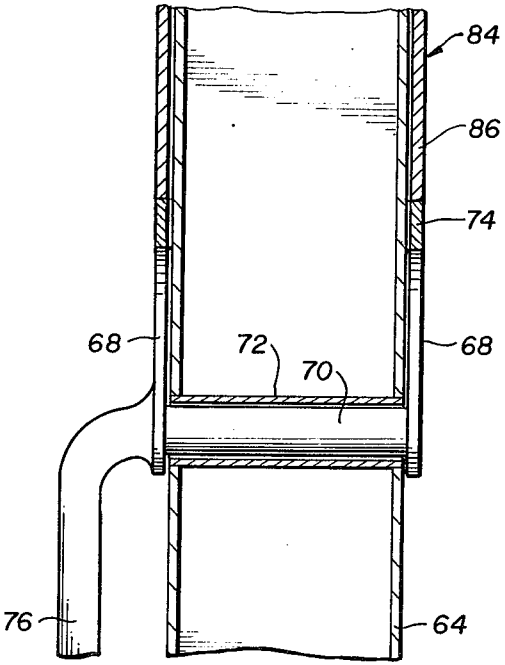
FIG. 10 is an enlarged elevational view, partly in section, of a portion of the shoring means shown in FIG. 9.
Figure 9:
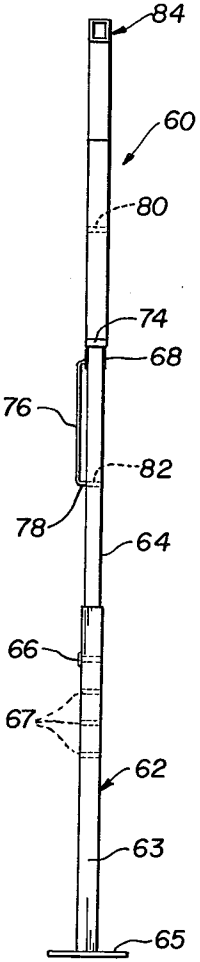
FIG. 9 is an end elevational view of the shoring means shown in FIG. 8.
Figure 8:
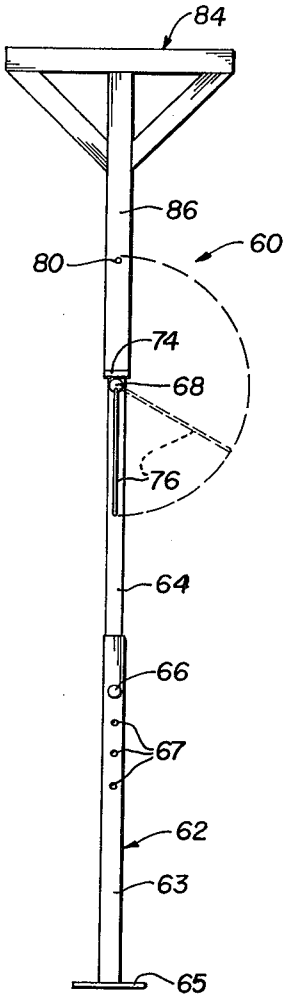
FIG. 8 is a front elevational view of a shoring means of the subject portable decking system.

FIGS. 8 through 10 illustrate the shoring means 60 of the portable decking system of the present invention. The shoring means 60 is utilized to support a decking panel in position when the concrete is poured thereon and is setting, and generally comprises a base 62, preferably formed of a tubular member 63 of square or rectangular cross section and a bottom plate 65 formed of a strong, lightweight material such as aluminum. Slidably mounted within the base 62 is an upstanding, elongated tubular member 64, preferably of a cross section corresponding to that of the member 63 of the base 62 and formed of a strong, lightweight material such as aluminum. The upstanding member 64 may be secured in a desired position relative to the base 62, for the purpose of varying the height of the shoring means 60, by any suitable means such as a locking pin 66 of the like releasably positioned in mating apertures 67 in the base 62 and shoring member 64.

At the upper end of the upstanding shoring member 64 a transverse or horizontal support member or portion 84 is secured thereto for engagement with the lower surface of a decking panel 50 when it is placed in position by the transporter 10. As an illustrative example, the support member 84 may be releasably mounted on the upper end of the shoring member 64 through the use of a tubular section 86 secured to the support member 84 and telescopically received over the shoring member 64 and releasably secured thereto in any suitable manner. In this manner, it is possible to utilize upper sections of different construction on the shoring member 64, depending on the nature of use of the shoring means 60.

For the purpose of providing a fine adjustment of the support portion 84 relative to the shoring member 64, a pair of cam members 68 are secured to opposite ends of a pivot pin 70 rotatably mounted within a bearing sleeve 72 extending transversely through and secured to the upstanding shoring member 64. As shown in FIG. 10, the cam members are mounted for eccentric rotation about the axis of a pivot pin 70. The cam members 68, pivot pin 70 and bearing sleeve 72 may be formed in any suitable configuration and of any suitable material, such as steel. For the purpose of reducing wear on the lower end of the support portion 84, a bushing 74 formed of steel or any other suitable material is disposed at the lower end of the support portion and is in engagement with the upper portions of the cam members 68.

An elongated handle member 76 is secured at one end to one of the cam members 68 adjacent the pivot pin 70 and is provided with a transversely extending locking portion 78 at the other end thereof. The locking portion 78 is adapted to be releasably received in an upper aperture 80 in the support member 84 and in a lower apperture 82 in the shoring member 64 for the purpose of releasably locking the cam members 68 in selected up or down positions. It will be readily seen, therefore, that by outward movement of the locking portion 78 and rotation of the handle member 76, as shown in broken lines in FIG. 8, the upper support portion or member 84 will be moved upwardly or downwardly a selected finite distance relative to the shoring member 64.

Although the nature of the use of the portable decking system of the present invention has already been described in the "Summary of the Invention" portion of this application, certain aspects of such use will be further described hereinafter to clarify the use of the components of the subject portable decking system, namely, the transporter 10, the decking panels 50 and the shoring means 60.

At the job site, a decking panel 50 is positioned on the transporter 10 by initial engagement with the rollers 24 at the upper ends of the transporter frame. After the decking panel is positioned on the rollers 24, the rollers are adjusted downwardly until the lower portion of the decking panel engages the upper surface of the transporter frame 12 and extension members 28 if the latter are used. A plurality of shoring means 60 may also be placed on the transporter 10 for movement thereby, by positioning the shoring means on the lower transverse members 14 of the transporter frame 12.

Thereafter, the jack 32 is actuated to move the support platform 40 and arms 42 of the transporter 10 into engagement with the lower surface of the decking panel 50. The locking lugs 44 on the arms 42 serve to engage adjacent portions of the longitudinal and transverse members 52 and 54 of the decking panel 50 for the purpose of retaining the decking panel on the transporter during movement of the latter. When the transporter 10 is moved to a position for the proper positioning of the decking panel 50, the jack 32 is again actuated to raise the support platform and arms 42 which, in turn, raises the decking panel 50 to the proper height. Because of the rotatability of the support platform 40, the decking panel 50 can be easily moved to its proper position.

After the decking panel 50 is properly positioned by the transporter 10, a plurality of shoring means 60 are vertically positioned and adjusted through the use of the locking pin 66 and mating apertures in the base 62 and shoring member 64 of each shoring means, to position the plate member 84 of each shoring means in engagement with the adjacent lower portion of the decking panel 50. The number and position of the shoring means 60 will depend on the size of the decking panel 50 and the anticipated load of concrete to be supported thereby.

After each shoring means 60 is properly positioned, the jack 32 of the transporter 10 is again actuated to lower the support platform 40 and arms 42 out of engagement with the decking panel 50, and the transporter is moved away from beneath the decking panel. The transporter 10 may then be used to transport another decking panel 50 and a plurality of shoring means 60 to a desired position.

A very fine adjustment of each shoring means 60 can be accomplished through the rotation of the handle 76 and cam members 68 mounted on the shoring member 64. After concrete has been poured and has cured on a decking panel 50 or a plurality of decking panels 50 connected together in any suitable manner, the shoring means 60 may be conveniently removed by moving the handle 76 and cam 68 to the lower position which will lower the support member 84 a sufficient distance to relieve pressure on the shoring means. Thereafter, the shoring member 60 may be lowered a greater distance within the base 62 by removal and repositioning of the locking pin 66 in mating apertures of the shoring member and base. Before the shoring means 60 are removed from supporting engagement with the decking panel 50, the transporter 10 is moved into position under the decking panel 50 and the platform 40 and support arms 42 thereof are moved upwardly by the jack 32 into engagement with the lower portion of the decking panel 50. Thereafter, the shoring means 60 may be removed from beneath the decking panel 50 and may be positioned on a lower portion of the transporter for movement elsewhere on the job site along with the decking panel 50. Preferably, the plate 55 on the upper surface of the decking panel 50 is coated with a suitable lubricant before the pouring of the concrete thereon so that the decking panel 50 may be easily removed from the cured concrete.

The above procedure is repeated for the transporting and positioning of additional decking panels and shoring means.

I claim:

1. A set of elements for use in a portable decking system for the construction of building units having a monolithic slab roof, said elements comprising:

a movable transporter for moving and positioning decking panels, said transporter comprising a support frame adapted to receive a decking panel on the upper portion thereof, movable means mounted on the lower portion of said support frame to enable said transporter to be moved on a support surface, and lifting means mounted on said support frame and engageable with a decking panel mounted thereon to move it upwardly above said upper portion to a desired position;

a decking panel adapted to be supported on the upper portion of said transporter and moved upwardly to a predetermined position by said lifting means for the pouring of concrete thereon; and a plurality of vertically adjustable shoring means adapted to be removably positioned on and conveyed by said transporter, said shoring means being removable from said transporter and adapted to engage and support said decking panel in said predetermined position to enable said transporter to be removed from said decking panel after it is moved to said predetermined position;

said transporter being movable beneath said decking panel after curing of the concrete thereon and said shoring means being movable downwardly out of engagement with said decking panel after said transporter is moved beneath said decking panel to enable said decking panel to be moved away from said predetermined position by said transporter.

2. The set of elements of claim 1 wherein a portion of said lifting means is rotatable so as to enable said decking panel to be rotatably adjusted in a substantially horizontal plane.

3. The set of elements of claim 1 wherein said transporter is provided with a plurality of substantially horizontal rollers at the upper end thereof to facilitate the positioning of said decking panel thereon.

4. The set of elements of claim 3 wherein said rollers are vertically adjustable to enable said decking panel to be lowered thereon into engagement with the upper support portion of said transporter.

5. The set of elements of claim 1 wherein said transporter is provided with vertically adjustable legs to vary the height thereof.

6. The set of elements of claim 1 wherein said transporter is provided with means for adjusting the length thereof.

7. The set of elements of claim 1 wherein said decking panel comprises a grid-like support frame and a plate secured to the upper surface of said grid-like support frame, said plate being adapted to receive the concrete thereon.

8. The set of elements of claim 7 wherein said decking panel is provided with means for adjusting the length and width thereof.

9. The set of elements of claim 1 wherein said shoring means comprises a base and an elongated shoring member movably mounted on said base for substantially vertical movement relative thereto.

10. The set of elements of claim 9 wherein said shoring means comprises means for adjusting the vertical position of said shoring member.

* * * * *